US008928447B2

(12) United States Patent
Inaba

(10) Patent No.: US 8,928,447 B2
(45) Date of Patent: Jan. 6, 2015

(54) REACTOR AND METHOD FOR PRODUCING SAME

(75) Inventor: Kazuhiro Inaba, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 42 days.

(21) Appl. No.: 13/703,883

(22) PCT Filed: May 27, 2011

(86) PCT No.: PCT/JP2011/062198

§ 371 (c)(1),
(2), (4) Date: Dec. 12, 2012

(87) PCT Pub. No.: WO2011/158632

PCT Pub. Date: Dec. 22, 2011

(65) Prior Publication Data

US 2013/0088318 A1 Apr. 11, 2013

(30) Foreign Application Priority Data

Jun. 16, 2010 (JP) ..... 2010-137116

(51) Int. Cl.
*H01F 27/02* (2006.01)
*H01F 5/00* (2006.01)

(Continued)

(52) U.S. Cl.
CPC ..... *H01F 27/255* (2013.01); *H01F 37/00* (2013.01); *H01F 27/362* (2013.01);

(Continued)

(58) Field of Classification Search
USPC ..... 336/83, 96, 200, 233, 90, 92, 221; 29/602.1, 605, 606
See application file for complete search history.

(56) References Cited

U.S. PATENT DOCUMENTS 4,783,711 A * 11/1988 Kitada et al. ..... 360/319

(Continued)

FOREIGN PATENT DOCUMENTS

JP 64-037816 A 2/1989
JP 64-037816 U 2/1989

(Continued)

OTHER PUBLICATIONS

Notification of Reasons for Rejection in Japan Patent Application No. 2010-137116, dated Dec. 2, 2013.

*Primary Examiner* — Tszfung Chan

(74) *Attorney, Agent, or Firm* — Venable LLP; Steven J. Schwarz; George L. Howarah

(57) ABSTRACT

A reactor 1α includes one coil 2, a magnetic core 3 to which the coil 2 is arranged, and a case 4 containing an assembly 10 of the coil 2 and the magnetic core 3. The magnetic core 3 includes an inner core portion 31 inserted into the coil 2, and a coupling core portion 32 disposed around the coil 2. The coupling core portion 32 is made of a mixture of magnetic powder and resin. The coil 2 is covered with the coupling core portion 32 and is enclosed within the case 4 in a sealed state. The reactor 1α includes, in an outermost surface region exposed at an opening of the case 4, a magnetic shield layer 5 made of non-magnetic powder, having smaller specific gravity than the magnetic powder and having electrical conductivity, and the resin. A small reactor capable of reducing magnetic flux leaked to the outside is thereby provided. A method of producing a small reactor capable of reducing magnetic flux leaked to the outside is also provided which produces the reactor 1α by filling the case 4 with a mixture of magnetic powder, non-magnetic powder, and resin, producing a state where the non-magnetic powder has floated to the opening side of the case 4 and the magnetic powder has precipitated on the bottom side of the case 4, and hardening the resin.

4 Claims, 4 Drawing Sheets

(51) Int. Cl.

| | |
|---|---|
| ***H01F 17/04*** | (2006.01) |
| ***H01F 27/24*** | (2006.01) |
| ***H01F 27/255*** | (2006.01) |
| ***H01F 37/00*** | (2006.01) |
| ***H01F 27/36*** | (2006.01) |
| ***H01F 41/02*** | (2006.01) |
| *H01F 3/10* | (2006.01) |

(52) U.S. Cl.

CPC ..... *H01F 41/02* (2013.01); *H01F 2003/106* (2013.01); *H01F 2017/048* (2013.01)

USPC ..... 336/90; 336/83; 336/92; 336/96; 336/200; 336/221; 336/233

(56) References Cited

U.S. PATENT DOCUMENTS

| | | | | |
|---|---|---|---|---|
| 6,392,525 | B1 * | 5/2002 | Kato et al. | 336/233 |
| 2002/0145824 | A1 * | 10/2002 | Tabakovic et al. | 360/126 |
| 2005/0012581 | A1 * | 1/2005 | Ono et al. | 336/90 |
| 2007/0052510 | A1 * | 3/2007 | Saegusa et al. | 336/92 |

FOREIGN PATENT DOCUMENTS

| | | | | |
|---|---|---|---|---|
| JP | 2006-261331 | A | | 9/2006 |
| JP | 2006261331 | A | * | 9/2006 |
| JP | 2009-033051 | A | | 2/2009 |
| JP | 2009033051 | A | * | 2/2009 |
| JP | 2009-200456 | A | | 9/2009 |
| JP | 2011-124310 | A | | 6/2011 |
| WO | WO-2011/089941 | A1 | | 7/2011 |

* cited by examiner

REACTOR AND METHOD FOR PRODUCING SAME

TECHNICAL FIELD

The present invention relates to a reactor used as a component of a power conversion apparatus, e.g., a vehicle-loaded DC-DC converter, and a method for producing the reactor. More particularly, the present invention relates to a reactor, which can reduce magnetic flux leaked to the outside and which has a small size.

BACKGROUND ART

There is a reactor as one of parts of a circuit for operations of stepping-up and stepping-down a voltage. In a typical form of a reactor employed, for example, in a converter that is loaded on a vehicle such as a hybrid car, a pair of coils, each formed by winding a wire, are disposed side by side around respective parts of a magnetic core having a annular shape, e.g., an O-like shape.

Patent Literature (PTL) 1 discloses a rector including one coil and the so-called pot type core, i.e., a magnetic core having an E-E shaped cross-section, the core including an inner core disposed inside the coil and an outer core disposed to cover substantially an entire outer periphery of the coil. The pot type core has a small size and is suitable as a component loaded on a vehicle where an installation space is small. Particularly, the reactor disclosed in PTL 1 can be produced in a smaller size by setting a saturation magnetic flux density of the inner core to be higher than that of the outer core, thus reducing a cross-sectional area of the inner core, by setting magnetic permeability of the outer core to be lower than that of the inner core, thus dispensing with a gap member, or by designing a structural form not using a case. Further, PTL 1 discloses, as a constituent material of the outer core, a mixture of magnetic powder and resin (hereinafter referred to as a "magnetic mixture").

CITATION LIST

Patent Literature

PTL 1: Japanese Unexamined Patent Application Publication No. 2009-033051

SUMMARY OF INVENTION

Technical Problem

However, the related-art reactor accompanies with a risk of a leakage of magnetic flux to the outside.

When the case is not used and magnetic permeability is low in a portion of the magnetic core, which portion is exposed to the outside, the magnetic flux is apt to easily leak to the outside because of a small difference in magnetic permeability between the exposed portion of the magnetic core and the outside (usually, the atmosphere). In particular, when the outer core is made of the above-mentioned magnetic mixture, the magnetic flux is apt to more easily leak to the outside because the magnetic permeability tends to reduce as the content of the resin in the magnetic mixture increases.

In a reactor 100 illustrated in FIG. 5, for example, leakage magnetic flux can be reduced by containing, in a case 140 made of a non-magnetic material, e.g., aluminum, an assembly 110 of a magnetic core 130, which includes an inner core 131 and an outer core 132, and a coil 120. Even in that case, however, it is difficult to reduce the magnetic flux leaked to the outside of the case 140 through an opening of the case 140. The magnetic flux leaked to the outside of the case 140 can be reduced, for example, by enlarging the case 140, as indicated by one-dot-chain lines in FIG. 5, to increase a distance L from an end surface of the coil 120 to the opening of the case 140, i.e., by increasing the thickness of the outer core 132 on the side close to the opening of the case 140. However, such a structure increases the height of the reactor and results in a larger size of the reactor.

Accordingly, one object of the present invention is to provide a reactor, which is less apt to cause a leakage of magnetic flux to the outside and which has a small size. Another object of the present invention is to provide a reactor producing method capable of producing a reactor, which is less apt to cause a leakage of magnetic flux to the outside and which has a small size.

Solution to Problem

In the reactor 100 illustrated in FIG. 5, it is conceivable, for example, to cover the opening of the case 140 with a cover member made of a nonmagnetic material. In that case, however, bolts or the likes for fixing the cover member to the case are required in addition to the cover member. This increases not only the number of parts, but also the number of assembly steps with the necessity of boring the case, arranging the cover member, and arranging and fixing the bolts or the likes, thus reducing productivity of the reactor. Further, if a gap is generated between the cover member and the magnetic core, there is a risk that the magnetic flux may leak through the gap. The generation of the gap can be prevented, for example, by forming the outer core with the above-mentioned magnetic mixture, and by embedding a part of the cover member in the resin of the magnetic mixture before the resin is hardened. In that case, particularly, by forming the cover member to have an outer contour in a concave-convex shape, a contact area between the cover member and the magnetic mixture can be increased such that the gap is harder to generate. Moreover, fixing members, such as bolts, can be dispensed with by embedding the cover member in the magnetic mixture. Nevertheless, the cover member is additionally needed.

In view of the foregoing situation, the present invention achieves the above-mentioned object with a reactor including a magnetic shield layer that can be formed in an outermost surface portion of the magnetic core at the same time as the magnetic core when the magnetic core is produced, without separately preparing a cover member, which is independent of a case, and fitting the cover member to the case.

The reactor according to the present invention includes one coil formed by winding a wire, a magnetic core to which the coil is arranged, and a case having an opening and containing an assembly of the coil and the magnetic core. The coil is enclosed within the case in a sealed state while at least a part of an outer periphery of the coil is covered with the magnetic core. A region of the magnetic core on the side close to the opening of the case is made of a mixture of magnetic powder and resin. Further, the reactor includes a magnetic shield layer made of non-magnetic powder, having smaller specific gravity than the magnetic powder and having electrical conductivity, and resin in an outermost surface region, which is exposed at the opening of the case, to cover the opening-side region of the magnetic core.

The reactor according to the present invention can be easily produced, for example, by one of the following producing methods according to the present invention. A first reactor producing method according to the present invention relates to a method for producing a reactor by containing, in a case having an opening, an assembly of one coil formed by winding a wire and a magnetic core to which the coil is arranged. The method includes a containing step, a filling step, and a hardening step as follows.

(1) Containing step: step of containing the coil in the case.

(2) Filling step: step of filling a mixture of magnetic powder, non-magnetic powder having smaller specific gravity than the magnetic powder and having electrical conductivity, and resin in the case to cover an outer periphery of the coil.

(3) Hardening step: step of hardening the resin after reaching a state where the non-magnetic powder has floated to the opening side of the case and the magnetic powder has precipitated on the bottom side of the case due to a difference in specific gravity between the magnetic powder and the non-magnetic powder.

Another example of the reactor producing method according to the present invention is carried out as the following reactor producing method according to the present invention. A second reactor producing method according to the present invention relates to a method for producing a reactor by containing, in a case having an opening, an assembly of one coil formed by winding a wire and a magnetic core to which the coil is arranged. The method includes a containing step, a magnetic mixture filling step, and a non-magnetic mixture filling step as follows.

(1) Containing step: step of containing the coil in the case.

(2) Magnetic mixture filling step: step of filling a mixture of magnetic powder and resin in the case to cover an outer periphery of the coil.

(3) Non-magnetic mixture filling step: step of filling a mixture of non-magnetic powder, having smaller specific gravity than the magnetic powder and having electrical conductivity, and resin above the mixture of the magnetic powder and the resin, and hardening the resins.

While the reactor according to the present invention has the structure that includes the magnetic core covering the outer periphery of the coil and the case having the opening, the reactor can effectively reduce magnetic flux leaked to the outside of the case because of including the magnetic shield layer, which is substantially made of a non-magnetic material, in the outermost surface region exposed at the opening of the case. Particularly, in the reactor according to the present invention, since the magnetic shield layer is formed integrally with the magnetic core by employing the non-magnetic powder and the resin, which typically constitutes a part of the magnetic core, it is possible to avoid, in comparison with the structure using an independent cover member, an increase in the number of parts including fixing members, e.g., bolts, and the number of steps including attachment of the cover member to the case, thus ensuring higher productivity. Further, the reactor of the present invention is typically formed in such a state that, in the mixture of the magnetic powder and the resin (hereinafter referred to as the "magnetic mixture"), which mixture constitutes the magnetic core, the magnetic powder in the outermost surface region exposed at the opening of the case is replaced with the non-magnetic powder. Therefore, the reactor has a smaller size than when the independent cover member is attached to the case. In addition, the size of the reactor according to the present invention is held small because it is a pot type reactor including only one coil.

With the producing method according to the present invention, since the magnetic shield layer can be formed at the same as when the magnetic mixture is formed, the steps of forming the cover member and assembling the cover member to the case are not needed and the reactor can be produced with higher productivity in comparison with the structure including the independent cover member.

In particular, with the first producing method according to the present invention, when forming the magnetic mixture and forming the magnetic shield layer, just one mixture filling step is required, whereby the number of steps is reduced and higher productivity of the reactor is ensured.

In particular, with the second producing method according to the present invention, since the magnetic mixture and the mixture of the non-magnetic powder and the resin (hereinafter referred to as the "non-magnetic mixture") are separately filled in the case, a state where the non-magnetic powder concentrated in the outermost surface region exposed at the opening of the case can be formed more reliably in a shorter time. Stated another way, while the second producing method according to the present invention requires a larger number of steps than the first producing method according to the present invention, it can shorten a producing time because a time needed for separation of the magnetic powder and the non-magnetic powder in the first producing method according to the present invention can be shortened or omitted. Hence the second producing method is superior in productivity of the reactor.

In one embodiment of the reactor according to the present invention, the magnetic core includes an inner core portion inserted into the coil, and a coupling core portion covering an outer periphery of the coil and made of the magnetic mixture, the inner core portion and the coupling core portion being integrated with each other by the resin of the magnetic mixture.

With the above-described embodiment, when the inner core portion and the coupling core portion are joined to each other, a bonding step is not required because no adhesive is needed, and the magnetic core can be formed at the same time as when the coupling core portion is formed. Further, the magnetic shield layer can also be formed at the same time as when the coupling core portion is formed. The reactor is formed upon the formation of the magnetic core and the magnetic shield layer. Accordingly, the above-described embodiment enables the formation of the coupling core portion, the formation of the magnetic core, the formation of the magnetic shield layer, and the fabrication of the reactor to be carried out at the same time. Thus, higher productivity of the reactor is obtained.

Moreover, in the above-described embodiment, the inner core portion has a higher saturation magnetic flux density than the coupling core portion, and the coupling core portion has lower magnetic permeability than the inner core portion.

With the above-described embodiment, since the inner core portion has a higher saturation magnetic flux density, a cross-sectional area of the inner core portion can be reduced in comparison with, e.g., a reactor in which a magnetic core is entirely made of a single type of material and the inner core portion and the coupling core portion have the same saturation magnetic flux density, when the magnetic flux is to be obtained at the same intensity. With the above-described embodiment, therefore, an outer diameter of the coil disposed around the inner core portion can also be reduced. Hence the reactor of the above-described embodiment can be further reduced in size. In addition, a smaller outer diameter of the coil can contribute to shortening the wire that constitutes the coil, and to reducing the resistance of the coil. As a result, the above-described embodiment can reduce a loss. From the viewpoint of downsizing the coil and reducing a loss, the saturation magnetic flux density of the inner core portion is preferably higher than that of the coupling core portion as far as possible. Thus, an upper limit of the saturation magnetic flux density is not set to a particular value.

Further, with the above-described embodiment, since the coupling core portion has lower magnetic permeability than the inner core portion and the coupling core portion is made of the magnetic mixture, the magnetic permeability of the entire magnetic core can be easily adjusted and hence, for example, a gap for preventing saturation of the magnetic flux can be dispensed with. Accordingly, for example, even when a gap between an inner peripheral surface of the coil and an outer peripheral surface of the inner core portion is set to be as small as possible, leakage magnetic flux does not generate through the gap, and a loss of the coil attributable to the leakage magnetic flux does not occur. Thus, the size of the reactor in the above-described embodiment can be further reduced by setting a smaller gap or preferably by substantially eliminating the gap.

Advantageous Effects of Invention

The reactor according to the present invention can reduce the magnetic flux leaked to the outside, and it has a small size. The reactor producing method according to the present invention can produce a reactor with high productivity, the reactor being able to reduce the magnetic flux leaked to the outside and having a small size.

DESCRIPTION OF EMBODIMENTS

Figure 4:
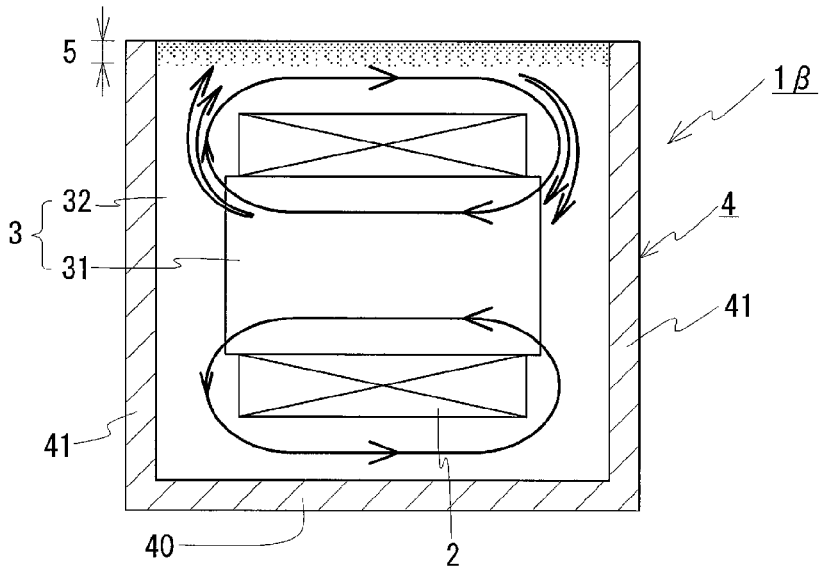
FIG. 4 is a schematic sectional view of a reactor according to Embodiment 2.
Figure 5:
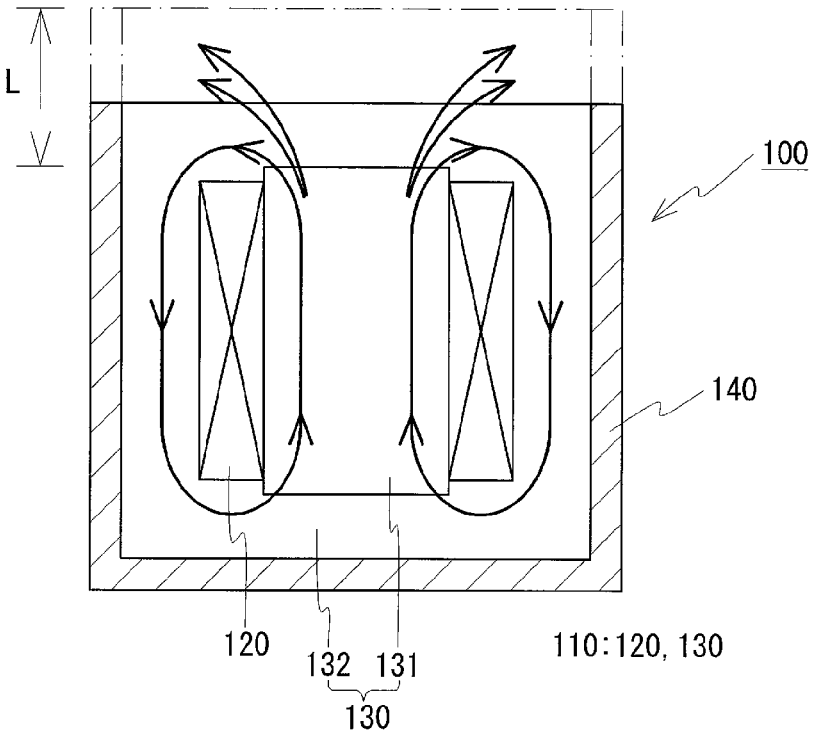
FIG. 5 is a schematic sectional view of a reactor including a case.

Reactors according to embodiments will be described below with reference to the drawings. The same symbols throughout the drawings denote the same components. It is to be noted that, in FIGS. 1 and 4, both ends of a wire are omitted for the sake of simplicity. Further, thick arrows in FIGS. 1 and 4 illustrate individual magnetic fluxes.

Embodiment 1

Figure 1:
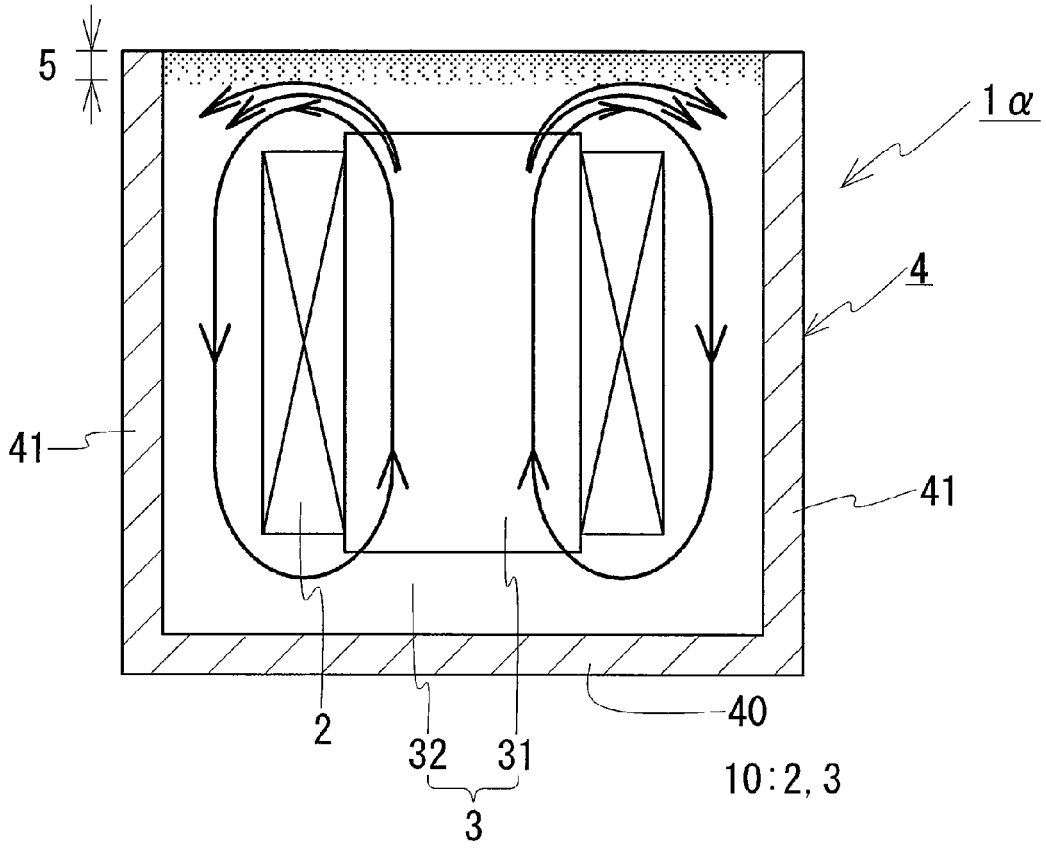
FIG. 1 is a schematic sectional view of a reactor according to Embodiment 1.
Figure 2:
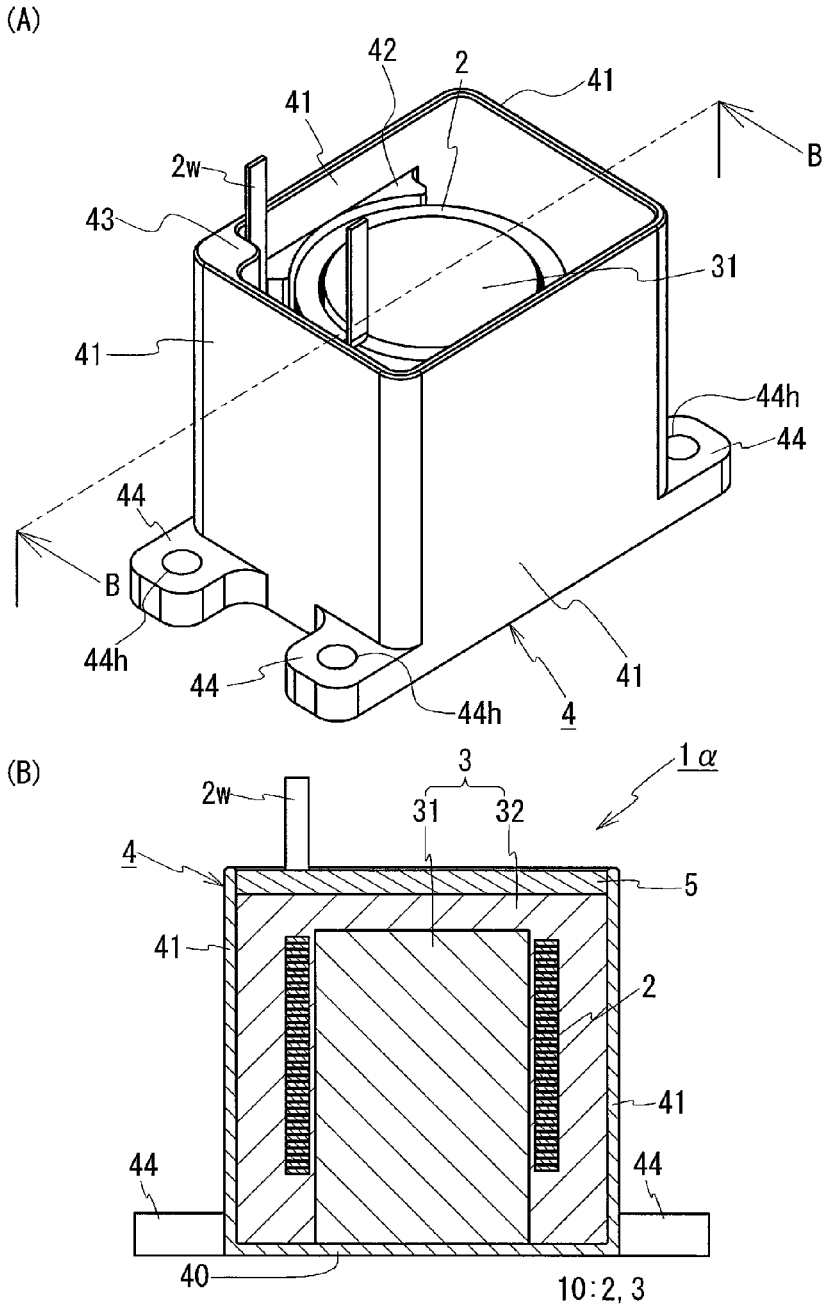
FIG. 2 illustrates the reactor according to Embodiment 1; specifically, (A) in FIG. 2 is a schematic perspective view and (B) in FIG. 2 is a sectional view taken along a line B-B in (A) in FIG. 2.
Figure 3:
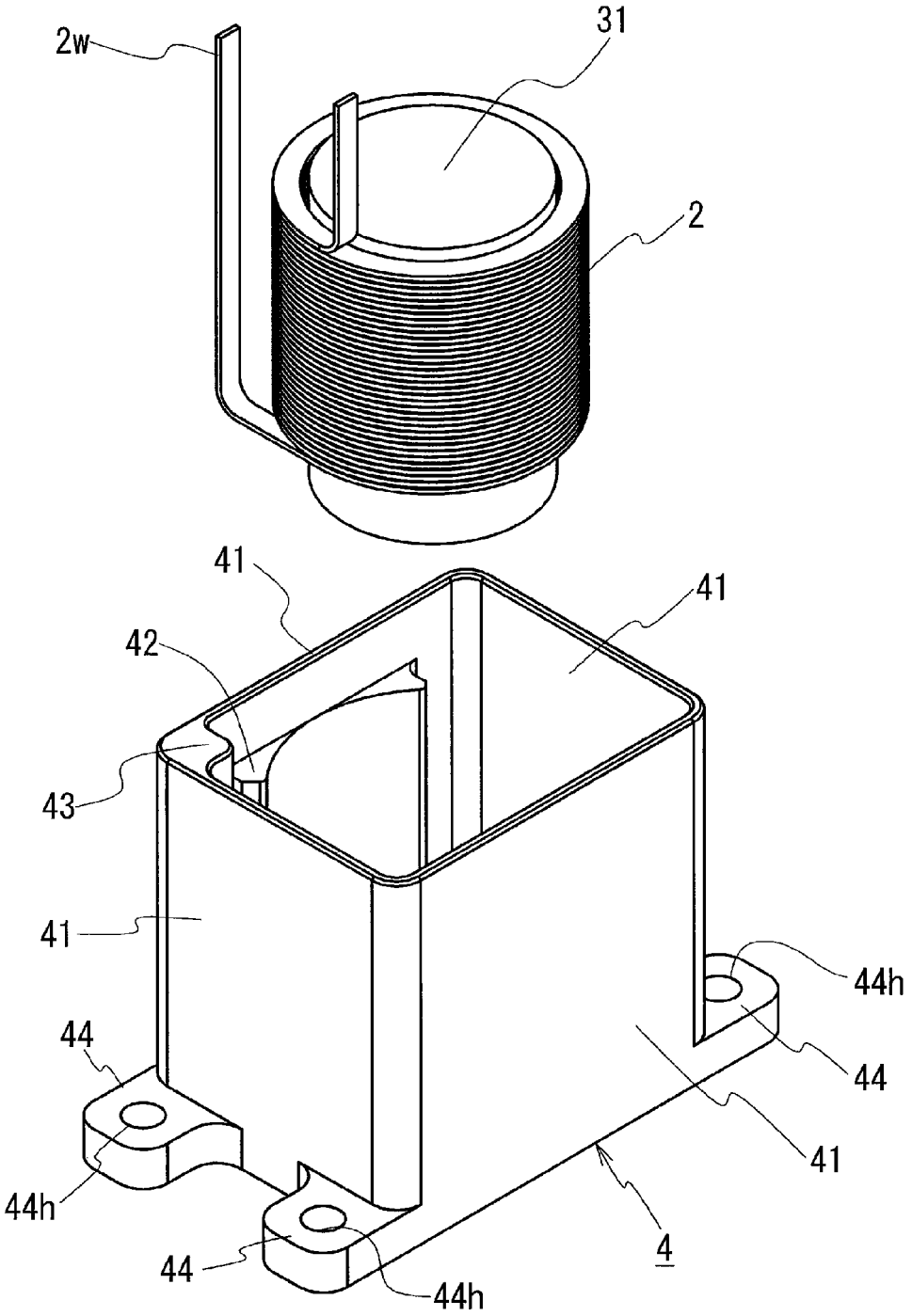
FIG. 3 is a schematic exploded view to explain constituent members of the reactor according to Embodiment 1.

A reactor 1α according to Embodiment 1 is described by mainly referring to FIGS. 1 to 3. The reactor 1α is the so-called pot type reactor including one coil 2 that is formed by winding a wire 2*w* (FIG. 2), and a magnetic core 3 to which the coil 2 is arranged. The reactor 1α further includes a case 4 containing an assembly 10 of the coil 2 and the magnetic core 3. The magnetic core 3 includes an inner core portion 31 inserted into the coil 2, and a coupling core portion 32 disposed around the coil 2 and coupled to the inner core portion 31. A closed magnetic path is formed by both the core portions 31 and 32. The coupling core portion 32 is made of a mixture of magnetic powder and resin. The coil 2 is covered with the coupling core portion 32 substantially over its entire outer periphery and is enclosed within the case 4 in a sealed state. The reactor 1α is featured in including a magnetic shield layer 5 in an outermost surface region that is exposed at an opening of the case 4. The individual components are described in more detail below.

[Coil 2]

The coil 2 is a cylindrical member formed by spirally winding one continuous wire. The wire 2*w* is preferably a coated wire having an insulating coating, made of an electrically insulating material, around a conductor made of a conductive material, e.g., copper or aluminum. Here, a coated rectangular wire is employed in which a conductor is a rectangular wire made of copper and an insulating coating is made of enamel (typically polyamide-imide). A thickness of the insulating coating is preferably 20 μm or more and 100 μm or less. The larger thickness of the insulating coating can further reduce pinholes and enhance insulation performance. The coil 2 is formed by winding the coated rectangular wire in an edgewise manner. Regardless of the edgewise winding, the coil can be comparatively easily formed because of having a cylindrical shape. In addition to the rectangular wire of which conductor has a rectangular cross-section, other wires having various cross-sectional shapes, such as circular and polygonal shapes, can also be optionally used as the wire 2*w*.

As illustrated in FIGS. 2 and 3, both ends of the wire 2*w* forming the coil 2 are disposed to extend over an appropriate length from a body of turns and are led out to the outside of the magnetic shield layer 5 through the coupling core portion 32 described later. A terminal member (not illustrated) made of a conductive material, e.g., copper or aluminum, is connected to a conductor portion of the wire at each of both the ends thereof, the conductor portion being exposed by peeling off the insulating coating. An external device (not illustrated), such as a power source for supplying electric power to the coil 2, is connected through the terminal members. The connection between the conductor portions of the wire 2*w* and the terminal members can be established, for example, by welding such as TIG welding, or pressure bonding. While both the ends of the wire 2*w* are led out parallel to the axial direction of the coil 2 in the drawing, a leading-out direction can be appropriately selected.

When the reactor 1α is installed onto an installation target, the reactor 1α is mounted in a layout where the coil 2 is contained in the case 4 with the axial direction of the coil 2 being perpendicular to a bottom surface 40 of the case 4 (such an arrangement is referred to as a "vertical layout" hereinafter).

[Magnetic Core 3]

The magnetic core 3 is the so-called pot type core, which includes a columnar inner core portion 31 inserted into the coil 2, and a coupling core portion 32 formed to cover the surroundings of an assembly of the coil 2 and the inner core portion 31, and which has an E-E shape, formed by combining two E's, in a cross-section of the magnetic core 3 cut along the axial direction of the coil 2. In particular, one of the features of the reactor 1α is that a constituent material of the inner core portion 31 and a constituent material of the coupling core portion 32 are different from each other, and both the portions 31 and 32 have different magnetic characteristics. More specifically, the inner core portion 31 has a higher saturation magnetic flux density than the coupling core portion 32, and the coupling core portion 32 has lower magnetic permeability than the inner core portion 31.

<<Inner Core Portion>>

The inner core portion 31 has a columnar outer shape along the shape of an inner peripheral surface of the coil 2, and it is entirely formed of a powder compact. While the inner core portion 31 is a solid member in this embodiment without including a gap member or an air gap, the inner core portion 31 may be fabricated in a form including the gap member or the air gap as appropriate. As another example, the inner core portion 31 may be made up a plurality of split pieces, and the split pieces may be joined to each other with an adhesive, thus providing the inner core portion 31 in an integral form.

The powder compact is typically obtained by compacting soft magnetic powder having an insulating coating on a surface thereof, or a powder mixture of the soft magnetic powder and a binder added to and mixed with the former as appropriate, and then firing the compacted powder at a temperature lower than the heat resistant temperature of the insulating coating. The powder compact can be easily formed in a three-dimensional shape. Therefore, the inner core portion having an outer shape in match with the shape of the inner peripheral surface of the coil, for example, can be easily formed. Further, because an insulator exists between magnetic particles in the powder compact, magnetic powders are insulated from each other and an eddy current loss can be reduced. Accordingly, even when high-frequency power is supplied to the coil, the eddy current loss can be held small.

Examples usable as the soft magnetic powder include iron-group metal powders made of Fe, Co, Ni, etc., Fe-based alloy powders made of Fe—Si, Fe—Ni, Fe—Al, Fe—Co, Fe—Cr, Fe—Si—Al, etc., rare-earth metal powders, and ferrite powder. In particular, the Fe-based alloy powders can more easily provide the powder compact having a higher saturation magnetic flux density than magnetic materials such as ferrite. The insulating coating formed on the soft magnetic powder can be made of, e.g., a phosphate compound, a silicon compound, a zirconium compound, an aluminum compound, or a boron compound. The binder can be made of, e.g., a thermoplastic resin, a non-thermoplastic resin, or a higher fatty acid. The binder disappears or changes to an insulator, e.g., silica, with the above-mentioned firing. The powder compact may be prepared by utilizing suitable one of known products.

The saturation magnetic flux density of the powder compact can be changed by selecting the material of the soft magnetic powder and by adjusting a mixing ratio between the soft magnetic powder and the binder, amounts of various types of coatings, etc. The powder compact having a higher saturation magnetic flux density can be obtained by employing the soft magnetic powder having a higher saturation magnetic flux density, or by reducing an amount of the mixed binder to increase a proportion of the soft magnetic material. In addition, changing the compacting pressure, specifically raising the compacting pressure, is also effective in increasing the saturation magnetic flux density. It is preferable to select the material of the soft magnetic powder and to adjust the compacting pressure such that the desired saturation magnetic flux density is obtained.

In this embodiment, the inner core portion 31 is formed of the powder compact that is fabricated using the soft magnetic powder provided with the insulating coating.

A length of the inner core portion 31 in the axial direction of the coil 2 (hereinafter referred to simply as a "length") can be selected as appropriate. In an example illustrated in FIG. 1, the length of the inner core portion 31 is somewhat longer than that of the coil 2, and both end surfaces of the inner core portion 31 and the vicinities thereof project respectively from end surfaces of the coil 2. However, the length of the inner core portion 31 may be the same as or somewhat shorter than that of the coil 2. When the length of the inner core portion 31 is equal to or longer than that of the coil 2, magnetic flux produced by the coil 2 can be caused to sufficiently pass through the inner core portion 31. Further, a length by which the inner core portion 31 projects from the coil 2 is selectable as appropriate. While lengths by which the inner core portion 31 projects from both the ends of the coil 2 are the same in the example illustrated in FIG. 1, a length by which the inner core portion 31 projects from one end surface of the coil 2 may be set larger than a length by which the inner core portion 31 projects from the other end surface of the coil 2 as in an example illustrated in FIG. 2. In the above-described vertical layout, particularly, the inner core portion 31 can be stably disposed in the case 4 by arranging the inner core portion 31 in the case 4 in such a state that one end surface of the inner core portion 31 projecting from the one end surface of the coil 2 is contacted with a bottom surface 40 of the case 4 as in the example illustrated in FIG. 2. Accordingly, it is easier to form the coupling core portion 32.

<<Coupling Core Portion>>

The coupling core portion 32 functions, as described above, not only to form the closed magnetic path together with the inner core portion 31, but also as a sealing member to cover the surroundings of the assembly of the coil 2 and the inner core portion 31 such that both the coil 2 and the inner core portion 31 are enclosed within the case 4 in a sealed state. Thus, in the reactor 1α, a molded and hardened body made of the mixture of the magnetic powder and the resin exists in a space from the bottom surface 40 of the case 4 to the opening side, and it constitutes the coupling core portion 32. The coupling core portion 32 and the inner core portion 31 are joined to each other by the resin, which is the constituent material of the coupling core portion 32, without any adhesive interposed therebetween. Thus, the magnetic core 3 is a one-piece unit entirely integrated without including any adhesive and any gap member.

The molded and hardened body can be typically formed by injection molding or cast molding. In the injection molding, magnetic powder made of a magnetic material and resin having fluidity are mixed with each other. A resulting mixture is poured into a shaping mold to be shaped under application of a predetermined pressure. The resin is then hardened. In the cast molding, after preparing a similar mixture to that used in the injection molding, the mixture is poured into a shaping mold to be shaped and is then hardened without applying pressure.

The magnetic powder used in any of the foregoing molding methods can be powder similar to the above-described soft magnetic powder used for the inner core portion 31. In particular, powder made of an iron-based material, e.g., pure iron powder or Fe-based alloy powder, can be preferably used as the soft magnetic powder for the coupling core portion 32. Because the iron-based material has a saturation magnetic flux density and magnetic permeability higher than those of ferrite, for example, a core having certain levels of the saturation magnetic flux density and the magnetic permeability can be obtained even when the content rate of the resin is relatively high. Coated powder having a coating made of ferric phosphate on the surface of a particle made of a soft magnetic material may also be used. Regardless of the type of the magnetic powder, an average particle diameter of the powder is preferably 1 μm or more and 1000 μm or less and more preferably 10 μm or more and 500 μm or less from the viewpoint of convenience in use.

Further, in any of the foregoing molding methods, a thermosetting resin, e.g., an epoxy resin, a phenol resin, or a silicone resin, can be preferably used as the resin that serves as a binder. When the thermosetting resin is used, the resin is thermally hardened by heating the molded body. A room-temperature setting resin or a cold setting resin may also be used. In that case, the molded body is left to stand at a room temperature or a relatively low temperature to harden the resin. The molded and hardened body contains non-magnetic resin in a larger amount in comparison with the powder compact and an electrical steel sheet described later. Accordingly, even when the soft magnetic powder similar to that used in the powder compact constituting the inner core portion 31 is used as the magnetic powder for the coupling core portion 32, the saturation magnetic flux density and the magnetic permeability of the coupling core portion 32 are held relatively low.

The magnetic permeability and the saturation magnetic flux density of the molded and hardened body can be adjusted by changing a mixing ratio between the magnetic powder and the resin serving as the binder. For example, the molded and hardened body having lower magnetic permeability can be obtained by reducing an amount of the mixed magnetic powder.

In this embodiment, the coupling core portion 32 is formed of the molded and hardened body that is fabricated by employing a mixture of coated powder and an epoxy resin, the coated powder having an average particle diameter of 100 μm or less, being made of the iron-based material, and including an insulating coating.

While the coupling core portion 32 is illustrated in this embodiment in the form substantially covering the entire surroundings of the assembly of the coil 2 and the inner core portion 31, the magnetic core 3 may be in the form that the coil 2 is partly not covered with the magnetic core 3 (although the coil 2 is entirely surrounded by the case 4) on condition that the magnetic core 3 covers an outer periphery of the coil 2 in its region positioned on the opening side of the case 4.

<<Magnetic Characteristics>>

The saturation magnetic flux density of the inner core portion 31 is preferably 1.6 T or more, more preferably 1.8 T or more, and most preferably 2 T or more. Further, the saturation magnetic flux density of the inner core portion 31 is preferably 1.2 or more times, more preferably 1.5 or more times, and most preferably 1.8 or more times that of the coupling core portion 32. With the inner core portion 31 having the saturation magnetic flux density relatively sufficiently higher than that of the coupling core portion 32, a cross-sectional area of the inner core portion 31 can be reduced. Further, the magnetic permeability of the inner core portion 31 is preferably 50 or more and 1000 or less and more preferably about 100 to 500.

The saturation magnetic flux density of the coupling core portion 32 is preferably 0.5 T or more and less than the saturation magnetic flux density of the inner core portion. Further, the magnetic permeability of the coupling core portion 32 is preferably 5 or more and 50 or less and more preferably about 5 to 30. With the magnetic permeability of the coupling core portion 32 satisfying the above-mentioned range, it is possible to avoid average magnetic permeability of the entire magnetic core 3 from becoming too large, and to realize a gapless structure, for example.

In this embodiment, the inner core portion 31 has the saturation magnetic flux density of 1.8 T and the magnetic permeability of 250, and the coupling core portion 32 has the saturation magnetic flux density of 1 T and the magnetic permeability of 10. The constituent materials of the inner core portion 31 and the coupling core portion 32 are preferably adjusted such that they have respective desired values of the saturation magnetic flux density and the magnetic permeability.

The case 4 containing the assembly 10 of the core 2 and the magnetic core 3 is a rectangular box having the bottom surface 40 that serves as a mounting-side surface of the reactor 1α when the reactor 1α is mounted onto the installation target (not illustrated), and lateral walls 41 vertically rising from the bottom surface 40, the box being opened on the side opposed to the bottom surface 40.

The shape and the size of the case 4 can be selected as appropriate. The case 4 may have, for example, a cylindrical shape extending along the assembly 10. Further, the case 4 is preferably made of a material that is non-magnetic and electrically conductive, such as aluminum, an aluminum alloy, magnesium, or a magnesium alloy. The case made of the non-magnetic material having electrical conductivity can effectively prevent the magnetic flux from leaking to the outside of the case. Further, the case made of a light-weight metal, e.g., aluminum, magnesium, or an alloy thereof, is suitable for use as one of parts of an automobile which are desired to have smaller weight, because that type of case has higher strength and is lighter than resin. In this embodiment, the case 4 is made of aluminum.

Moreover, the case 4 illustrated in FIG. 2 includes a guide projection 42 that is provided on an inner peripheral surface of the lateral wall 41 and that has the functions of not only suppressing rotation of the coil 2, but also guiding the coil 2 when the coil 2 is inserted, a positioning portion 43 that is provided at one corner of the case 4 to project from the inner peripheral surface thereof and that is utilized to position the end of the wire 2*w*, and a coil support portion (not illustrated) that is provided on the inner peripheral surface of the case 4 to project from the bottom wall 40, thereby supporting the coil 2 and positioning the height of the coil 2 relative to the case 4. By employing the case 4 including the guide projection 42, the positioning portion 43, and the coil support portion, the coil 2 can be arranged at a desired position inside the case 4 with high accuracy, and the inner core portion 31 can be positioned relative to the coil 2 with high accuracy. Alternatively, the guide projection 42, etc. may be dispensed with. As another example, one or more separate members may be prepared and placed in the case for, e.g., positioning of the coil 2. In particular, when the separate member is provided as a molded and hardened body made of a similar material to the constituent material of the coupling core portion 32, the separate member can be not only easily integrated with the coupling core portion 32 when the coupling core portion 32 is formed, but also utilized to form a magnetic path. In addition, the case 4, illustrated in FIG. 2, includes mounting portions 44 in which bolt holes 44*h* are formed for fixing the reactor 1α to the installation target (not illustrated) by bolts. With the provision of the mounting portions 44, the reactor 1α can be easily fixed to the installation target by bolts.

[Magnetic Shield Layer]

The magnetic shield layer 5 is disposed to cover a region of the coupling core portion 32 on the side close to the opening of the case 4. The magnetic shield layer 5 is made of a mixture of non-magnetic powder, which has smaller specific gravity than the magnetic powder used to form the coupling core portion 32 and which has electrical conductivity, and the resin used to form the coupling core portion 32. In other words, the constituent materials of the magnetic shield layer 5 are partly in common to those of the coupling core portion 32.

More specifically, the magnetic shield layer 5 is a region positioned at an outermost surface of the content in the case 4 and substantially made of the mixture of the non-magnetic powder and the resin. In that region, a volume ratio of the non-magnetic powder to the mixture is 20% or more. The coupling core portion 32 is defined as a region where the volume ratio of the non-magnetic powder to the mixture is less than 20%.

The boundary between the magnetic shield layer 5 and the coupling core portion 32 is in a state where the non-magnetic powder primarily constituting the magnetic shield layer 5 and the magnetic powder primarily constituting the coupling core portion 32 are mixed with each other. With the producing method described later, the non-magnetic powder may exist to some extent in the coupling core portion 32. However, the presence of a small amount of the non-magnetic powder in the coupling core portion 32 is allowed because the non-magnetic powder functions as a filler to uniformly disperse the magnetic powder in the coupling core portion 32.

Because the magnetic shield layer 5 is made of the above-mentioned non-magnetic powder and the above-mentioned resin that is generally non-magnetic, the magnetic shield layer 5 can prevent a leakage of magnetic flux to the outside of the case 4 through the opening of the case 4. Further, because of having electrical conductivity, the non-magnetic powder can generate an eddy current upon receiving the magnetic flux from the coil 2, and hence can cancel a magnetic field produced by the coil 2 near the opening of the case 4 with a magnetic field generated by the eddy current. In other words, the non-magnetic powder can prevent the magnetic flux from the coil 2 from leaking to the outside of the case 4 with the magnetic field generated by the eddy current. Thus, the magnetic shield layer 5 can suppress the leakage of magnetic flux to the outside of the case 4.

Examples of a constituent material of the non-magnetic powder having electrical conductivity include metal materials, such as aluminum (specific gravity: 2.7), an aluminum alloy, magnesium (specific gravity: 1.7), and a magnesium alloy, which have smaller specific gravity than iron-based materials (specific gravity of iron: 7.8), and non-metal materials, such as zirconia (specific gravity: typically about 6.0). Examples of the aluminum alloy include an Al—Si based alloy, and an Al—Mg based alloy. Examples of the magnesium alloy include a Mg—Al based alloy (e.g., an AZ alloy, an AS alloy, and an AM alloy in accordance with the ASTM standards), and a Mg—Zr based alloy (e.g., a ZK alloy in accordance with the ASTM standards). In particular, the metal materials tend to generate the eddy current, and they are expected to be able to effectively prevent the leakage of magnetic flux.

The above-mentioned non-magnetic powder enables the magnetic shield layer 5 to be easily formed with the producing method, described later, by utilizing the fact that the non-magnetic powder has smaller specific gravity than the magnetic powder constituting the coupling core portion 32. Further, when the magnetic shield layer 5 is formed, an amount of the non-magnetic powder as a raw material is preferably adjusted such that the region where the volume ratio of the non-magnetic powder is 20% or more has a thickness comparable to that of the case 4. An average particle diameter of the non-magnetic powder is preferably 1 μm or more and 1000 μm or less and more preferably 10 μm or more and 500 μm or less from the viewpoint of convenience in use.

[Other Constituent Elements]

To enhance insulation between the coil 2 and the magnetic core 3 and insulation between the coil 2 (particularly the end portions of the wire 2*w*) and the magnetic shield layer 5, insulators are preferably disposed at positions of the coil 2 where the coil 2 contacts with the magnetic core 3 and the magnetic shield layer 5. For example, it is conceivable to affix insulating tapes to or arrange insulating paper or insulating sheets over the inner and outer peripheral surfaces of the coil 2, and to fit insulating tubes over parts of the wire 2*w* forming the coil 2. Alternatively, a bobbin (not illustrated) made of an insulating material may be disposed around the inner core portion 31. The bobbin may be, e.g., a tubular member covering the outer periphery of the inner core portion 31. Insulation between the end surfaces of the coil 2 and the coupling core portion 32 can be enhanced by employing the bobbin that has annular flanges extending outward from both ends of the tubular member. Insulating resin, such as a polyphenylene sulfide (PPS) resin, a liquid crystal polymer (LCP), or a polytetrafluoroethylene (PTFE) resin, can be preferably used as a constituent material of the bobbin.

[Size of Reactor]

When the reactor 1α including the case 4 has a capacity of about 0.2 liter (200 $cm^3$) to 0.8 liter (800 $cm^3$), the reactor 1α can be preferably used as a vehicle-mounted part (the capacity is 280 $cm^3$ in this embodiment).

[Intended Use]

The reactor 1α can be preferably applied to uses under energization conditions of, e.g., a maximum current (DC): about 100 A to 1000 A, an average voltage: about 100 V to 1000 V, and a useful frequency: 5 kHz to 100 kHz, typically to a component of a vehicle-mounted power conversion apparatus for an electric car and a hybrid car. In such typical use, the reactor 1α is expected to be preferably utilized by adjusting the inductance of the reactor 1α so as to satisfy the conditions that the inductance is 10 μH or more and 1 mH or less when a supplied DC current is 0 A, and that the inductance during a maximum current carrying state is 30% or more of the inductance in the case of 0 A.

[Reactor Producing Method (1)]

The reactor 1α can be produced, for example, as follows. First, the coil 2 and the inner core portion 31 formed of a powder compact are prepared. The inner core portion 31 is inserted into the coil 2, as illustrated in FIG. 3, to thereby fabricate an assembly of the coil 2 and the inner core portion 31. As described above, insulators may be disposed between the coil 2 and the inner core portion 31 as required.

Next, the above-mentioned assembly is placed in the case 4. The assembly can be disposed at a predetermined position in the case 4 with high accuracy by utilizing the above-described guide projection 42, etc. A mixture of the magnetic powder constituting the coupling core portion 32 (FIGS. 1 and 2), the non-magnetic powder constituting the magnetic shield layer 5 (FIGS. 1 and 2), and the resin, which is in common to both the coupling core portion 32 and the magnetic shield layer 5, is prepared and filled into the case 4. In the mixture of the magnetic powder, the non-magnetic powder, and the resin (in a state before hardening of the resin), the content of the non-magnetic powder is set to about 1% by volume to 10% by volume, and the total content of the magnetic powder and the non-magnetic powder is set to about 20% by volume to 60% by volume (the content of the resin is set to about 40% by volume to 80% by volume). As a result, the coupling core portion 32, which has the magnetic permeability of 5 to 50, and the magnetic shield layer 5 can be formed as described above. In this embodiment, the content of the magnetic powder is 35% by volume, the content of the non-magnetic powder (here, aluminum powder having an average particle diameter of 150 μm) is 5% by volume, and the content of the resin is 60% by volume.

After filling the mixture of the magnetic powder, the non-magnetic powder, and the resin into the case 4, the case 4 is left to stand at temperature held at a level not hardening the resin, without immediately hardening the resin, until the non-magnetic powder floats toward the opening side of the case 4 and the magnetic powder precipitates toward the bottom surface 40 of the case 40 due to the difference in specific gravity between the magnetic powder and the non-magnetic powder such that the both the types of powders come into a separated state. Thereafter, the resin is hardened in the state where the magnetic powder and the non-magnetic powder are separated from each other as described above, whereby the reactor 1α is obtained. In this embodiment, the resin is hardened after leaving the filled case 4 to stand in a state held for several minutes to several tens minutes at about 80° C. for the separation of the magnetic powder and the non-magnetic powder.

The temperature to be held when separating the magnetic powder and the non-magnetic powder from each other can be appropriately selected depending on the resin used. When the color of the magnetic powder and the color of the non-magnetic powder differ from each other as in the case of, e.g., iron powder and aluminum powder, the separated state of both the types of powders can be recognized, for example, by visually confirming colors of the powders through the opening of the case 4. A time during which the filled case 4 is to be left to stand is preferably adjusted while continuing the visual confirmation. A time required for separating the magnetic powder and the non-magnetic powder from each other varies depending on not only the mixing ratio between the magnetic powder and the non-magnetic powder, but also the resin used. In view of such a variation, the reactor can be produced with higher productivity by previously preparing test pieces using various materials, measuring respective standing times required for the test pieces, and then appropriately selecting the standing time corresponding to the material used. Further, by employing a transparent case when the test pieces are each fabricated, it is possible to easily visually confirm the interior of the mixture in addition to the above-described visual confirmation of the surface of the mixture through the opening of the case.

[Reactor Producing Method (2)]

Alternatively, the reactor 1α can be produced, for example, as follows. First, the assembly of the coil 2 and the inner core portion 31 is placed in the case 4 as in the producing method (1).

Next, a mixture (magnetic mixture) of the magnetic powder and the resin both constituting the coupling core portion 32 (FIGS. 1 and 2) is prepared and filled in the case 4. The resin is then hardened. In the magnetic mixture, a ratio between the magnetic powder and the resin is adjusted such that the coupling core portion 32 has the desired magnetic characteristics.

Next, a mixture (non-magnetic mixture) of the non-magnetic powder constituting the magnetic shield layer 5 (FIGS. 1 and 2) and resin similar to that used in the coupling core portion 32 is filled above the magnetic mixture constituting the coupling core portion 32. The resin is then hardened. In the non-magnetic mixture, a ratio between the non-magnetic powder and the resin is adjusted such that the volume ratio of the non-magnetic powder is 20%. The non-magnetic mixture may be filled after completely hardening the resin in the magnetic mixture constituting the coupling core portion 32. Alternatively, the non-magnetic mixture may be filled after hardening the resin in the magnetic mixture to such an extent that the magnetic powder in the magnetic mixture and the non-magnetic powder in the non-magnetic mixture are not mixed with each other, instead of completely hardening the resin in the magnetic mixture. In the latter case, because the resin in the magnetic mixture constituting the coupling core portion 32 is not yet completely hardened, it is expected that the resin in the non-magnetic mixture constituting the magnetic shield layer 5 is more easily compatible with the resin in the non-magnetic mixture, and that a gap is harder to generate between the coupling core portion 32 and the magnetic shield layer 5.

The resin in the coupling core portion 32 and the resin in the magnetic shield layer 5 can be prepared by using different resins or different additives, e.g., hardeners, which are mixed in the resins. For example, viscosity of the resin in the magnetic mixture constituting the coupling core portion 32 and viscosity of the resin in the non-magnetic mixture constituting the magnetic shield layer 5 may be set different from each other by changing the type of the hardener. When the magnetic shield layer 5 and the coupling core portion 32 are separately formed, the viscosity of the resin in the non-magnetic mixture constituting the magnetic shield layer 5 can be increased, for example, because of no need of the above-described separation step. On other hand, when the resin in the coupling core portion 32 and the resin in the magnetic shield layer 5 are resins having similar properties as described before, the coupling core portion 32 and the magnetic shield layer 5 tend to more closely contact with each other.

With any of the above-described producing methods (1) and (2), after hardening the resins, the reactor 1α is obtained in which regions covering the outer periphery of the coil 2 are substantially constituted by the mixture of the magnetic powder and the resin, and a region spanning over a certain thickness from the outermost surface, which is exposed at the opening of the case 4, is substantially constituted by the mixture of the non-magnetic powder and the resin (similar to the resin in the coupling core portion).

Advantageous Effects

Because of including the magnetic shield layer 5, the reactor 1α can effectively suppress a leakage of the magnetic flux, produced by the coil 2, to the outside of the case 4. Further, since the magnetic shield layer 5 can be formed at the same time as the coupling core portion 32, there is no need of fabricating a separate member, e.g., a cover member, and assembling the cover member to the case 4. Thus, the reactor 1α has higher productivity.

Another reason why the reactor 1α has higher productivity is that the reactor 1α has an adhesive-less structure where, as described above, no adhesives are used in producing the magnetic core 3. Further, in the reactor 1α, since the inner core portion 31 is formed of the powder compact, the saturation magnetic flux density can be simply adjusted, and even a complicated three-dimensional shape can be easily formed. This point also increases productivity of the reactor 1α.

In addition, the reactor 1α has a small size because of containing just one coil 2. In the reactor 1α, particularly, since the saturation magnetic flux density of the inner core portion 31 is higher than that of the coupling core portion 32, a cross-sectional area of the inner core portion 31 (i.e., a surface thereof through which the magnetic flux passes) can be reduced when the magnetic flux is to be obtained at the same intensity as that produced by a magnetic core, which is made of a single type of material and which provides a uniform saturation magnetic flux density over the entire core. The use of the above-described inner core portion 31 can further reduce the size of the reactor 1α. Moreover, the reactor 1α can be formed in a gap-less structure including no gap members because the inner core portion 31 has a higher saturation magnetic flux density and the coupling core portion 32 has lower magnetic permeability. Thus, the reactor 1α has a smaller size than a reactor including a gap. The gap-less structure enables the coil 2 to be disposed closer to the inner core portion 31, whereby the size of the reactor 1α can be further reduced. Additionally, in the reactor 1α, since the outer shape of the inner core portion 31 is columnar following the shape of the inner peripheral surface of the cylindrical coil 2, the coil 2 and the inner core portion 31 can be easily positioned closer to each other, thus resulting in a smaller size of the reactor 1α.

Besides, because of including the case 4, the reactor 1α can not only protect the assembly 10 of the coil 2 and the magnetic core 3 against external environments causing intrusion of dust, corrosion, etc., but also mechanically protect the assembly 10. Further, since the surface of the coupling core portion 32 is covered with the magnetic shield layer 5, corrosion of the magnetic powder can be suppressed even when a material susceptible to corrosion, e.g., iron, is used as the magnetic powder. In other words, the magnetic shield layer 5 is able to function as a protective member against the external environments and a mechanical protective member for the magnetic core 3 (coupling core portion 32) and the coil 2. Moreover, when the case 4 and the magnetic shield layer 5 are each primarily made of metal, they can be utilized as heat dissipation paths, thus providing the reactor 1α with good heat dissipation properties. Particularly, since the inner core portion 31 including the coil 2 disposed therein is contacted with the bottom surface 40 of the case 4 as illustrated in FIG. 2 and the magnetic shield layer 5 containing a metal component is disposed on the opening side of the case 4, heat of the coil 2 can be effectively dissipated from both the bottom surface side and the opening side of the case 4. Moreover, in the reactor 1α, since magnetic characteristics can be easily modified by adjusting the ratio between the magnetic powder and the resin both constituting the coupling core portion 32, the inductance can be easily adjusted.

Embodiment 2

The structural form including the coil 2 in the vertical layout has been described above in Embodiment 1. As an alternative, the coil 2 and the inner core portion 31 may be contained in the case 4 with the axial direction of the coil 2 being parallel to the bottom surface 40 of the case 4 (such an arrangement is referred to as a "horizontal layout" hereinafter), as in a reactor 1β illustrated in FIG. 4.

In the horizontal layout, as illustrated in FIG. 4, the opening of the case 4 tends to increase and an area of the coupling core portion 32 exposed at the opening of the case also tends to increase in comparison with the vertical layout of Embodiment 1. However, because the reactor 1β of Embodiment 2 includes the magnetic shield layer 5 at the outermost surface region exposed at the opening of the case 4, it is able to effectively suppress a leakage of the magnetic flux, produced by the coil 2, to the outside of the case 4 from the coupling core portion 32. Thus, even when an area of the coupling core portion 32 exposed at the opening of the case 4 is relatively large and the magnetic flux tends to leak in a larger amount to the outside of the case 4 as in the reactor 1β of Embodiment 2, the leakage of the magnetic flux can be effectively suppressed with the provision of the magnetic shield layer 5.

The reactor 1β of Embodiment 2 can also be easily produced by the above-described producing method (1) or (2) similarly to the reactor 1α of Embodiment 1.

Modification 1

Embodiments 1 and 2 have been described above in connection with the construction of ensuring insulation between the coil 2 and the magnetic core 3 by the insulating coating of the wire 2*w*, which forms the coil, or by insulators separately prepared. Alternatively, a rector may be practiced in a form including a coil molded product (not illustrated) made up of a coil and an inner resin portion (not illustrated) that covers the surface of the coil. The coil molded product is described in detail below, whereas detailed description of the other construction is omitted because the other construction is similar to that in each of Embodiments 1 and 2.

In one exemplary form, the coil molded product includes a coil, an inner core portion inserted into the coil, and an inner resin portion covering the surface of the coil to keep a shape of the coil and to hold the coil and the inner core portion integrally with each other.

In another exemplary form, the coil molded product includes a coil and an inner resin portion covering the surface of the coil to keep a shape of the coil, the inner resin portion having a hollow hole in which an inner core portion is inserted and disposed. In that form, resin constituting the inner resin portion within the coil can be caused to have the function of positioning the inner core portion by adjusting a thickness of the resin constituting the inner resin portion such that the inner core portion is disposed at an appropriate position within the coil, and by making a shape of the hollow hole matched with an outer shape of the inner core portion. Accordingly, the inner core portion can be easily inserted and disposed at a predetermined position within the coil in the coil molded product.

In a form where the entire coil is substantially covered with the inner resin portion except for both the ends of the wire, since the inner resin portion is interposed between the substantially entire periphery of the coil and the magnetic core, the insulation between the coil and the magnetic core can be enhanced. In an alternative form where a turn forming portion of the coil is partly exposed from the inner resin portion, the coil molded product has a concave-convex outer shape, whereby a contact area between the coupling core portion and the resin can be increased and adhesion between the coil molded product and the coupling core portion can be enhanced. When the inner resin portion is formed to have a concave-convex outer shape to such an extent as not making the coil exposed, it is possible to not only enhance the insulation between the coil and the magnetic core, but also to ensure higher adhesion between the coil and the magnetic core with the inner resin portion interposed between them. A thickness of the inner resin portion is, e.g., about 1 mm to 10 mm.

The resin constituting the inner resin portion can be preferably made of an insulating material that has heat resistance to such an extent as not being softened at a maximum reachable temperature of the coil and the magnetic core during use of a reactor including the coil molded product, and that can be shaped by transfer molding or injection molding. For example, a thermosetting resin such as an epoxy resin, or a thermoplastic resin such as a PPS resin or a LCP can be preferably used as the above-mentioned constituent resin. Further, a reactor tending to more easily dissipate heat of the coil and having better heat dissipation properties can be obtained by employing the constituent resin mixed with filler that is made of at least one type of ceramics selected from silicon nitride, alumina, aluminum nitride, boron nitride, and silicon carbide. Moreover, the inner resin portion can be utilized to hold the coil in a more compressed state than in a state having a free length, thus providing the coil molded product in which the coil length is appropriately adjusted.

The coil molded product can be produced by arranging, in a mold, the coil and a molding core, or the coil and the inner core portion, filling the resin constituting the inner resin portion into the mold in a state where the coil is appropriately compressed, and hardening the resin. For example, a producing method for a coil molded product, described in Japanese Unexamined Patent Application Publication No. 2009-218293, can be used.

Using the coil molded product described above is advantageous in enhancing the insulation between the coil and the magnetic core, and enabling the coil to be more easily handled during assembly of a reactor because the outer shape of the coil is held by the inner resin portion, thereby providing higher productivity of the reactor. In particular, by employing the coil molded product in which the coil and the inner resin portion are integrally molded by the inner resin portion, handling of the coil and the inner resin portion is facilitated because they are not separated from each other. Further, since the coil and the inner resin portion can be contained in the case at the same time, the productivity of the reactor is further increased. In particular, by employing the coil molded product in which the inner resin portion holds the coil in a compressed state, the length of the coil in the axial direction thereof can be shortened and the size of the reactor can be further reduced.

Modification 2

Embodiments 1 and 2 have been described above in connection with the inner core portion 31 that is made of the powder compact. In addition, the inner core portion may be made of a stack that is formed by stacking electrical steel sheets, typically silicon steel sheets. The electrical steel sheets can easily provide a magnetic core having a higher saturation magnetic flux density than when the powder compact is used.

It is to be noted that the above-described embodiments can be appropriately modified without departing from the gist of the present invention, and they are not limited to the constructions described above.

INDUSTRIAL APPLICABILITY

The reactor according to the present invention can be used as a component of a power conversion apparatus, such as a two-way DC-DC converter loaded on a vehicle, e.g., a hybrid car, an electric car, or a fuel cell car. The reactor producing method according to the present invention can be preferably utilized in producing the reactor of the present invention.

REFERENCE SIGNS LIST

1α, 1β Reactors
10 Assembly
2 Coil
2*w* Wire
3 Magnetic Core
31 Inner Core Portion
32 Coupling Core Portion
4 Case
40 Bottom Surface
41 Side Wall
42 Guide Projection
43 Positioning Portion
44 Mounting Portion
44*h* Bolt Hole
5 Magnetic Shield Layer
100 Reactor
110 Assembly
120 Coil
130 Magnetic Core
131 Inner Core
132 Outer Core
140 Case

The invention claimed is:

1. A reactor comprising one coil formed by winding a wire, a magnetic core to which the coil is arranged, and a case having an opening and containing an assembly of the coil and the magnetic core, wherein the coil is enclosed within the case in a sealed state while at least a part of an outer periphery of the coil is covered with the magnetic core, a region of the magnetic core on a side close to the opening of the case is made of a mixture of magnetic powder and resin, a magnetic shield layer made of non-magnetic powder is disposed in an outermost surface region, which is exposed at the opening of the case, to cover the opening-side region of the magnetic core, the magnetic shield layer is a mixture of the magnetic powder and the resin, or a mixture of the magnetic powder and another resin similar to the resin, the non-magnetic powder has electrical conductivity and smaller specific gravity than the magnetic powder, the boundary between the magnetic shield layer and the region of the magnetic core on a side close to the opening of the case is in a state where the non-magnetic powder and the magnetic powder are mixed with each other, and a volume ratio of the non-magnetic powder is 20% or more in the magnetic shield layer and less than 20% in the region of the magnetic core on a side close to the opening of the case.

2. The reactor according to claim 1, wherein the magnetic core includes an inner core portion inserted into the coil, and a coupling core portion covering an outer periphery of the coil and made of the aforesaid mixture, the inner core portion and the coupling core portion are integrated with each other by the resin of the aforesaid mixture, the inner core portion has a higher saturation magnetic flux density than the coupling core portion, and the coupling core portion has lower magnetic permeability than the inner core portion.

3. A reactor producing method for producing a reactor by containing, in a case having an opening, an assembly of one coil formed by winding a wire and a magnetic core to which the coil is arranged, the method comprising the steps of:

containing the coil in the case;

filling a mixture of magnetic powder, non-magnetic powder having smaller specific gravity than the magnetic powder and having electrical conductivity, and resin in the case to cover an outer periphery of the coil, and hardening the resin after leaving the case at a temperature not hardening the resin and reaching a state where the non-magnetic powder has floated to the opening side of the case and the magnetic powder has precipitated on the bottom side of the case due to a difference in specific gravity between the magnetic powder and the non-magnetic powder.

4. A reactor producing method for producing a reactor by containing, in a case having an opening, an assembly of one coil formed by winding a wire and a magnetic core to which the coil is arranged, the method comprising the steps of:

containing the coil in the case;

filling a mixture of magnetic powder and resin in the case to cover an outer periphery of the coil, hardening the resin, and after hardening the resin, filling a mixture of non-magnetic powder, having smaller specific gravity than the magnetic powder and having electrical conductivity, and another resin similar to the resin of the mixture of magnetic powder to cover the outer periphery of the coil above the mixture of the magnetic powder and the resin, and hardening the another resin similar to the resin of the mixture of magnetic powder to cover the outer periphery of the coil.

* * * * *